United States Patent [19]

Wines, Jr. et al.

[11] 4,130,123

[45] Dec. 19, 1978

[54] PORTABLE NURSING DEVICE

[75] Inventors: Roy L. Wines, Jr.; Roy L. Wines, III, both of Southampton, N.Y.

[73] Assignee: Roy L. Wines & Son, Inc., Southampton, N.Y.

[21] Appl. No.: 858,859

[22] Filed: Dec. 8, 1977

Related U.S. Application Data

[62] Division of Ser. No. 681,493, Apr. 29, 1976, Pat. No. 4,072,157.

[51] Int. Cl.[2] ..... A47K 1/02

[52] U.S. Cl. ..... 134/56 R; 134/152; 4/167; 4/187 R

[58] Field of Search ..... 4/1, 167, 187 R, 159; 134/58 R, 58 DL, 95, 99, 107, 115 R, 115 G, 152, 170, 56 R, 56 D, 57 R, 57 DL

[56] References Cited

U.S. PATENT DOCUMENTS

| | | | |
|---|---|---|---|
| 3,059,653 | 10/1962 | Ingolia | 134/115 G X |
| 3,759,276 | 9/1973 | Nolte | 134/57 DL |
| 4,051,858 | 10/1977 | Mele | 134/56 R |
| 4,072,157 | 2/1978 | Wines, Jr. et al. | 134/115 R X |

*Primary Examiner*—Robert L. Bleutge

*Attorney, Agent, or Firm*—Clarence A. O'Brien; Harvey B. Jacobson

[57] ABSTRACT

A mobile cabinet encloses a plurality of basins or receptacles to which hot and cold water may be conducted under control of valves for cleaning, washing and drinking purposes through flexible conduits and from which water is drained through a flexible waste conduit. A water heater and a waste drain pump associated with one of the receptacles cooperates with other facilities therein to clean articles during a timed-controlled cleaning cycle, while manually operated valves control the supply of water to the other receptacles for washing and drinking purposes.

2 Claims, 8 Drawing Figures

PORTABLE NURSING DEVICE

This is a division of application Ser. No. 681,493 filed April 29, 1976, now U.S. Pat. No. 4,072,157.

BACKGROUND OF THE INVENTION

This invention relates to a self-contained, portable nursing unit by means of which various patient-nursing operations may be performed in a more rapid, efficient and sanitary fashion.

Portable nursing aid units are generally known. However, such portable nursing units are not usually related to those operations which require the supply of water at different temperatures and drainage of waste liquids in connection with implement cleaning, washing and drinking functions. The foregoing nursing functions which may be of a menial nature, nevertheless require the expenditure of a considerable amount of nursing time and contribute to the high cost of operating hospital institutions.

Although valve controlled systems for supply and draining of liquid to and from liquid receiving receptacles, is generally known, there has been no adaptation of such systems to the particular environment with which the present invention is concerned, namely portable and mobile nursing units. It is therefore an important object of the present invention to provide a portable or mobile nursing unit having a manually and automatically controlled valve system through which various nursing operations or functions are performed involving the cleaning of implements, the washing of a patient and the supply of drinking water to the patient.

SUMMARY OF THE INVENTION

In accordance with the present invention, a mobile cabinet adapted to be wheeled to a desired location such as adjacent to the bed of a hospital patient, encloses a plurality of basins or receptacles to which water is supplied through flexible conduits and from which liquid wastes are drained through a flexible waste conduit. The supply conduits may be respectively connected to a source of hot and cold water for supply of water at different temperatures to a cleaning chamber or receptacle within which implements are cleaned and to a water spigot overlying a wash basin adapted to be extracted from the cabinet through an opening therein. The cleaning receptacle or chamber, on the other hand, is fixedly mounted within the cabinet and access thereto is provided by means of a door or closure which is releasably latched in the closed position. An invertable holding bracket is mounted within the cleaning receptable to support implements such as bedpans and through which the implement or article to be cleaned is inverted during a cleaning cycle for exposure to water sprays discharged from spray tubes fixedly positioned within the cleaning receptacle. The water discharged through the spray tubes may be heated by means of an electrical heating device enclosed within the cabinet. The cleaning water as well as other waste materials are drained from the cleaning receptacle and forced through a macerator by means of a drain pump. The drained liquid may be conducted to the waste conduit or recycled by means of a recycling pump into the cleaning chamber. A detergent may be injected into the cleaning chamber during the cleaning cycle while the liquid is being recirculated. The cleaning cycle is initiated in response to closing the door to the cleaning chamber. At the end of the cleaning cycle, the door holding latch is released so as to permit opening of the door and removal of the cleansed articles and to enable loading of other aritcles into the cleaning receptacle. The cabinet also provides facility for dispensing cold water and ice.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
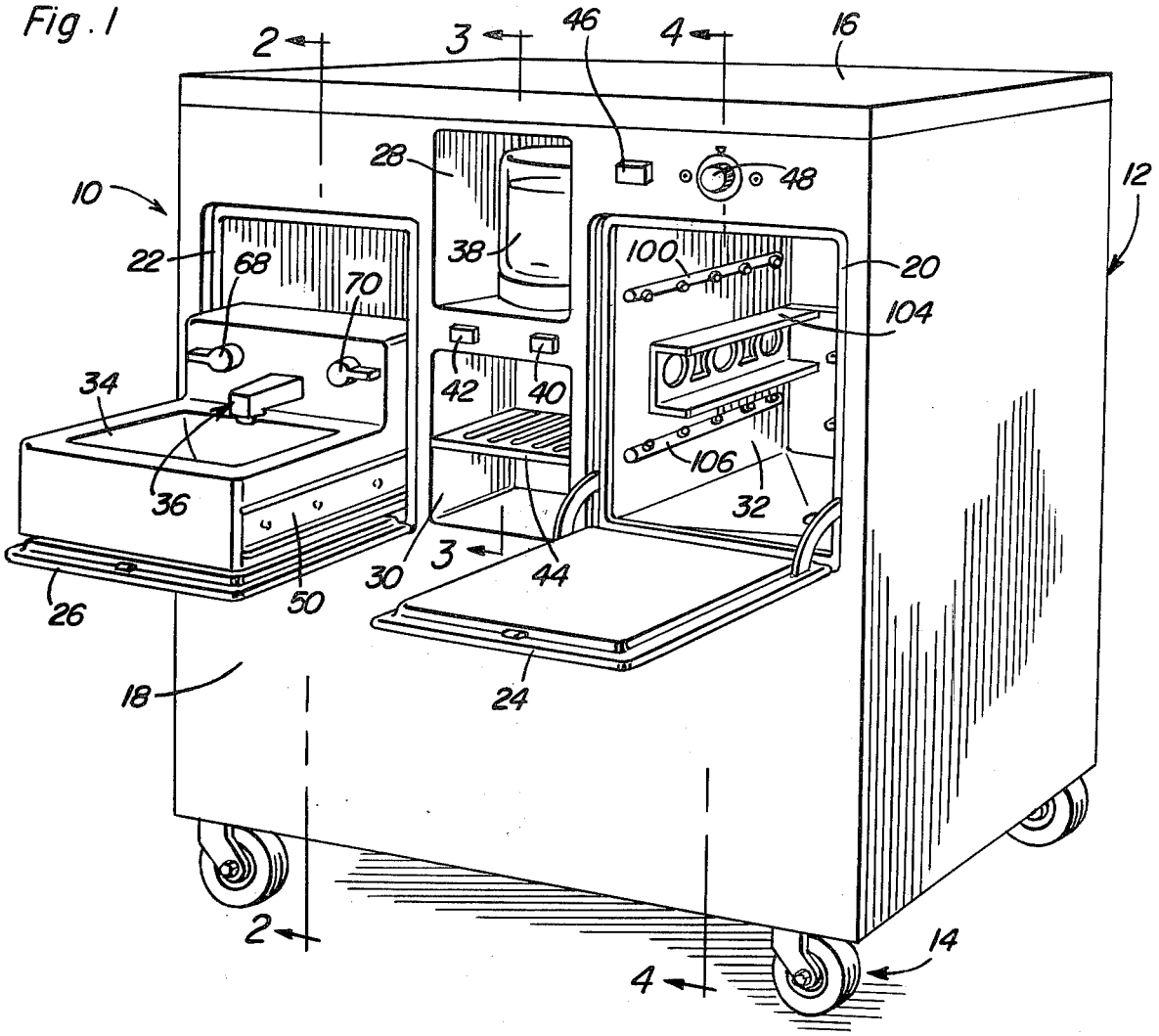
FIG. 1 is a perspective view illustrating a portable nursing unit constructed in accordance with the present invention.

Referring now to the drawings in detail, FIG. 1 illustrates a portable nursing unit constructed in accordance with the present invention and generally referred to by reference numeral 10. The nursing unit is housed within a cabinet generally referred to by reference numeral 12. The cabinet is rendered mobile by means of a plurality of caster wheel assemblies 14 by means of which the nursing unit may be readily wheeled to any desired location such as a location adjacent to the bed of a hospital patient. Access to the interior of the cabinet for repair and maintenance purposes may be provided by means of a removable top panel 16. The various nursing and patient service operations to be performed by use of the unit 10 are made available at the front service panel 18 of the cabinet. As shown, the front service panel of the cabinet is provided with a pair of relatively large rectangular openings 20 and 22 adapted to be closed by doors or closure devices 24 and 26 that are hingedly connected to the front panel of the cabinet adjacent the lower ends of the openings. Located between the openings 20 and 22, are a pair of vertically spaced, recessed cavities 28 and 30 of generally rectangular shape.

The opening 20 in the front panel 18 of the cabinet provides access to a cleaning chamber 32 formed by a receptacle fixedly mounted within the cabinet. Articles such as bedpans are adapted to be cleaned within the chamber 32 as will be explained in detail hereinafter. The opening 22 on the other hand provides access to a pull-out wash basin 34 having a valve controlled spigot assembly 36 associated therewith. The wash basin 34 and spigot assembly 36 are adapted to be supported over the door 26 in its open position as shown in FIG. 1, the basin being displaced to a storage position within the cabinet upon closing of the door 26 as will be explained in detail hereinafter. The upper cavity 28 formed within the front service panel 18 is adapted to mount of cold water storage container 38 from which cold water is adapted to be dispensed through a valve 40 upon actuation of its push button type valve operator. Another push button operator 42 located adjacent to the push button operator 40 controls the dispensing of ice, as will be explained hereafter, into a tumbler adapted to be placed on a supporting tray 44 located within the lower cavity 30. The door 24 hereinbefore referred to is adapted to be latched in its closed position in order to seal the chamber 32 during a cleaning cycle. The door latch may be released by depression of a latch releasing push button 46 mounted on the service panel 18 above the opening 20 adjacent to a timer selector control knob 48. The selector control knob is adapted to enable the user to select the duration of the cleaning cycle.

Figure 2:
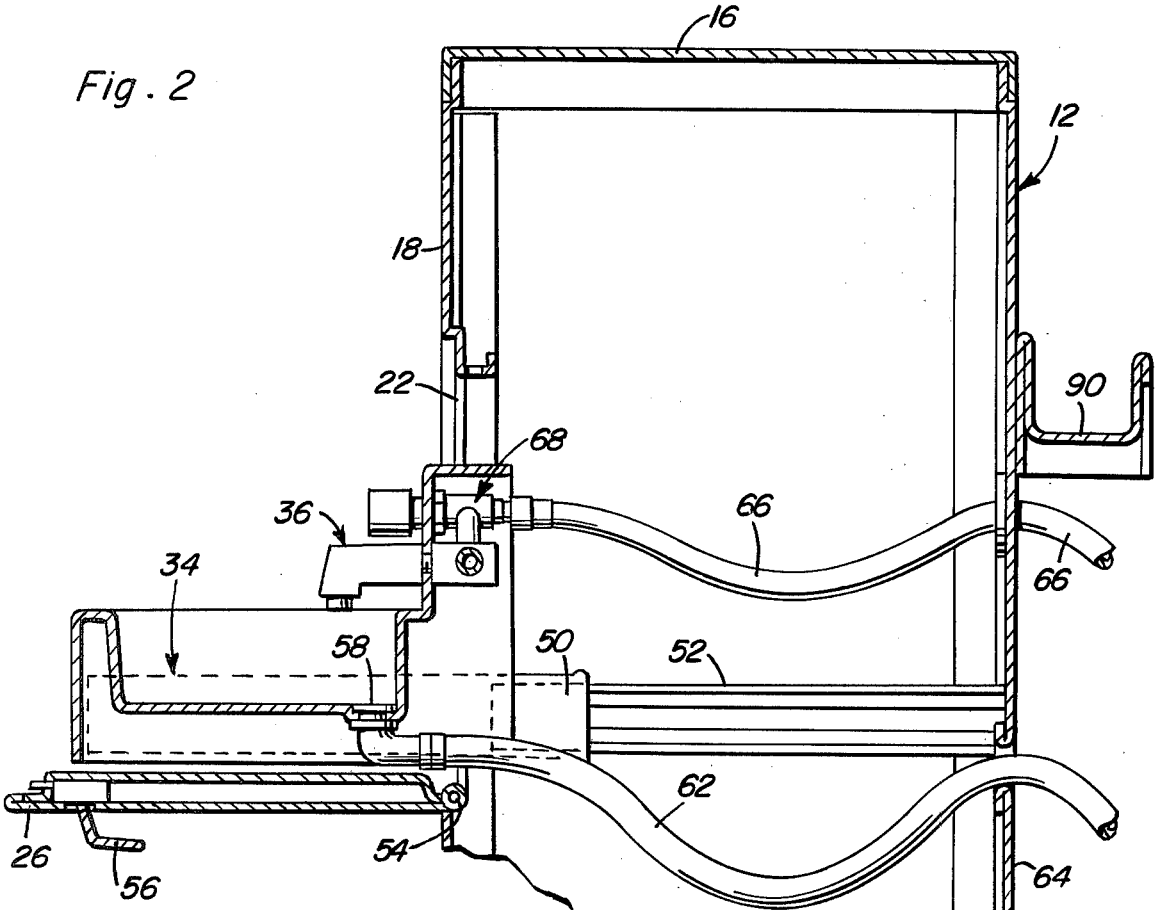
FIG. 2 is a partial side sectional view taken substantially through a plane indicated by section lines 2—2 in FIG. 1.

As more clearly seen in FIG. 2, the wash basin 34 is supported for slidable displacement between the position illustrated externally of the cabinet 12 to an internal storage position by means of a pair of slides 50 secured to the sides of the basin and slidably mounted on fixed slide tracks 52 secured to the inside of the cabinet side panels. The basin 34 is accordingly displaced rearwardly into the cabinet for storage purposes and to permit pivotal closing of the door 26 connected to the cabinet at the bottom of the opening 22 by means of a hinge 54. A handle 56 is secured to the outside surface of the door 26 as shown. A drain opening 58 is formed in the basin and is connected by means of an elbow 60 to a flexible drain hose 62 which extends rearwardly from the back panel 64 of the cabinet. A cold water supply hose 66 also extends into the cabinet through the back panel 64 and is adapted to be connected to a cold water valve assembly 68 associated with the spigot 36. A hot water valve 70 is also associated with the spigot and is adapted to be connected to a flexible hot water hose. Thus, hot or cold water may be dispensed through the spigot 36 into the basin 34 for washing purposes. Water may drain from the basin through the drain hose 62.

Figure 8:
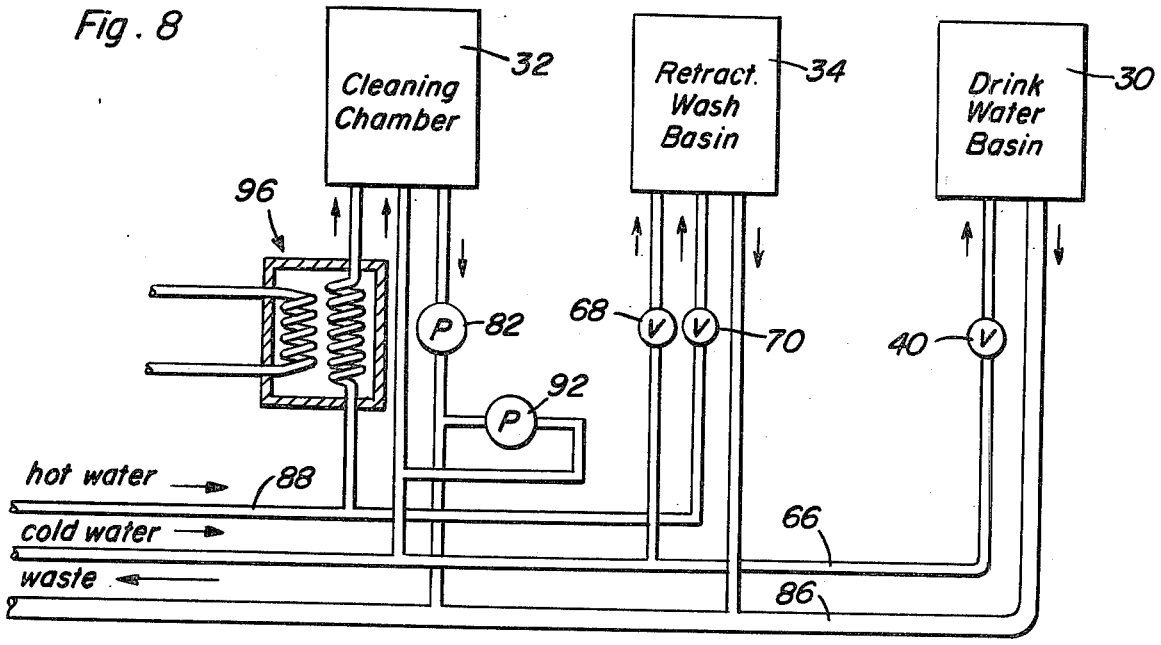
FIG. 8 is a schematic diagram illustrating the fluid circuit associated with the portable nursing unit.

As more clearly seen in FIGS. 4 and 5, the cleaning receptacle or chamber 32 exposed through the opening 20 includes a drain pan bottom 72 located just below the hinge 74 by means of which the door 24 is pivotally connected to the cabinet for closing the opening 20. When the opening 20 is closed, the chamber 32 is sealed. Accordingly, a sealing gasket 76 is mounted on the opening for engagement by the door 24 in its closed position. Further, a releasable latch mechanism 78 of any well known type is mounted on the door for holding the door closed until the end of a cleaning cycle and upon actuation of the latch release push button 46 aforementioned in connection with FIG. 1. The bottom 72 of the cleaning chamber receptacle 32 is connected by means of a flange coupling assembly 80 to a macerator and pump assembly 82 by means of which refuse and liquids are reduced to a liquified slurry suitable for outflow through the fitting 84 to a waste conduit 86. The drain conduit 62 aforementioned in connection with the wash basin 34, is connected to this waste conduit 86. Thus, the cold water supply conduit 66 aforementioned, the waste conduit 86 as well as a hot water conduit 88 are interconnected in parallel to the cleaning chamber receptacle 32 and the retractible wash basin assembly 34 as schematically diagramed in FIG. 8. The cold water supply conduit 66 as well as the drain conduit 86, are connected to the drink water basin formed by the cavity 30. The three conduits 66, 86 and 88 are in the form of flexible hoses adapted to be stored on a storage rack 90 fixed to the rear panel 64 of the cabinet as more clearly seen in FIG. 2. The flexible conduits are adapted to be plugged into or releasably attached to sources of hot and cold water and a waste drain associated with fixed plumbing terminals installed adjacent desired locations.

Figure 4:
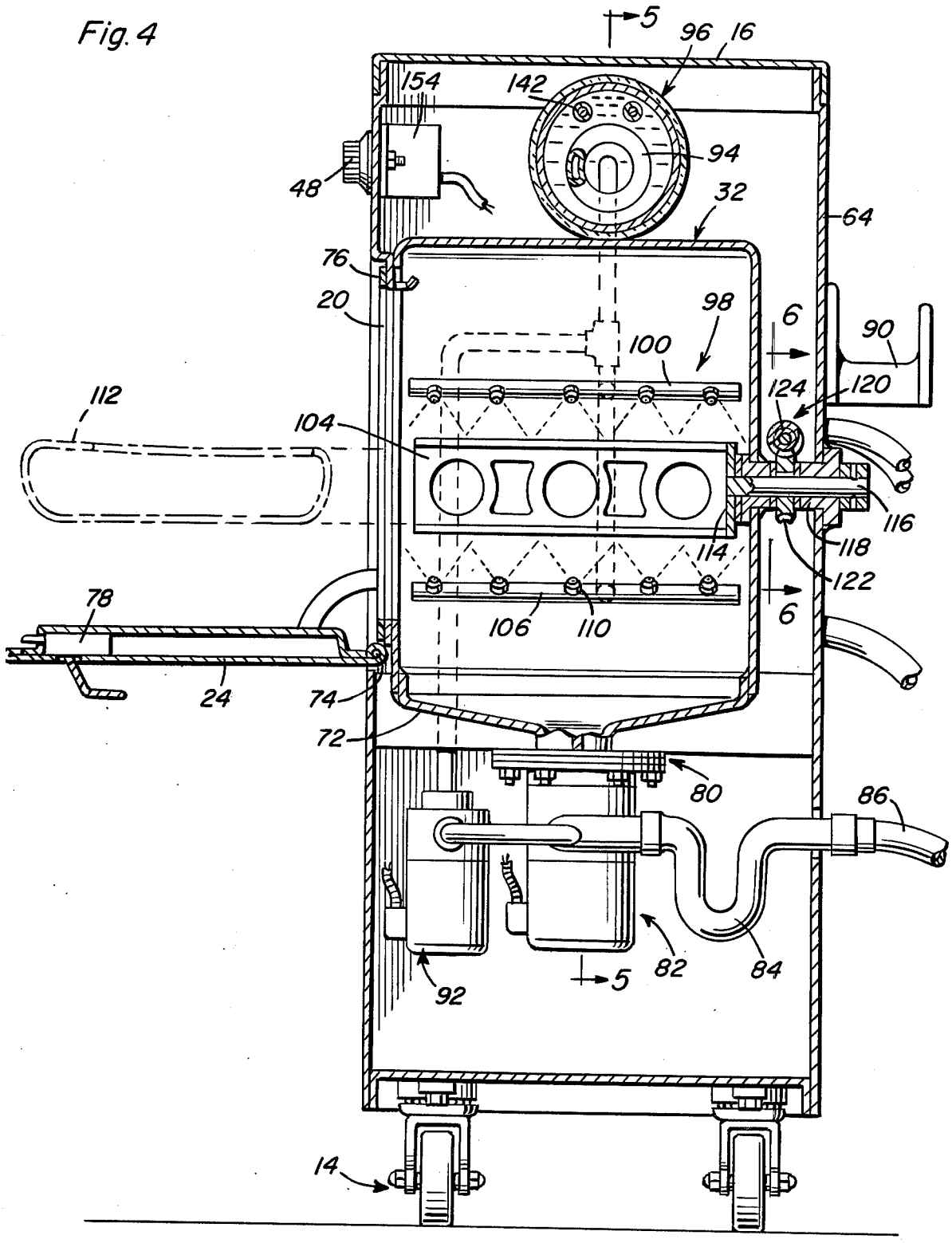
FIG. 4 is a side sectional view taken substantially through a plane indicated by section lines 4—4 in FIG. 1.
Figure 5:
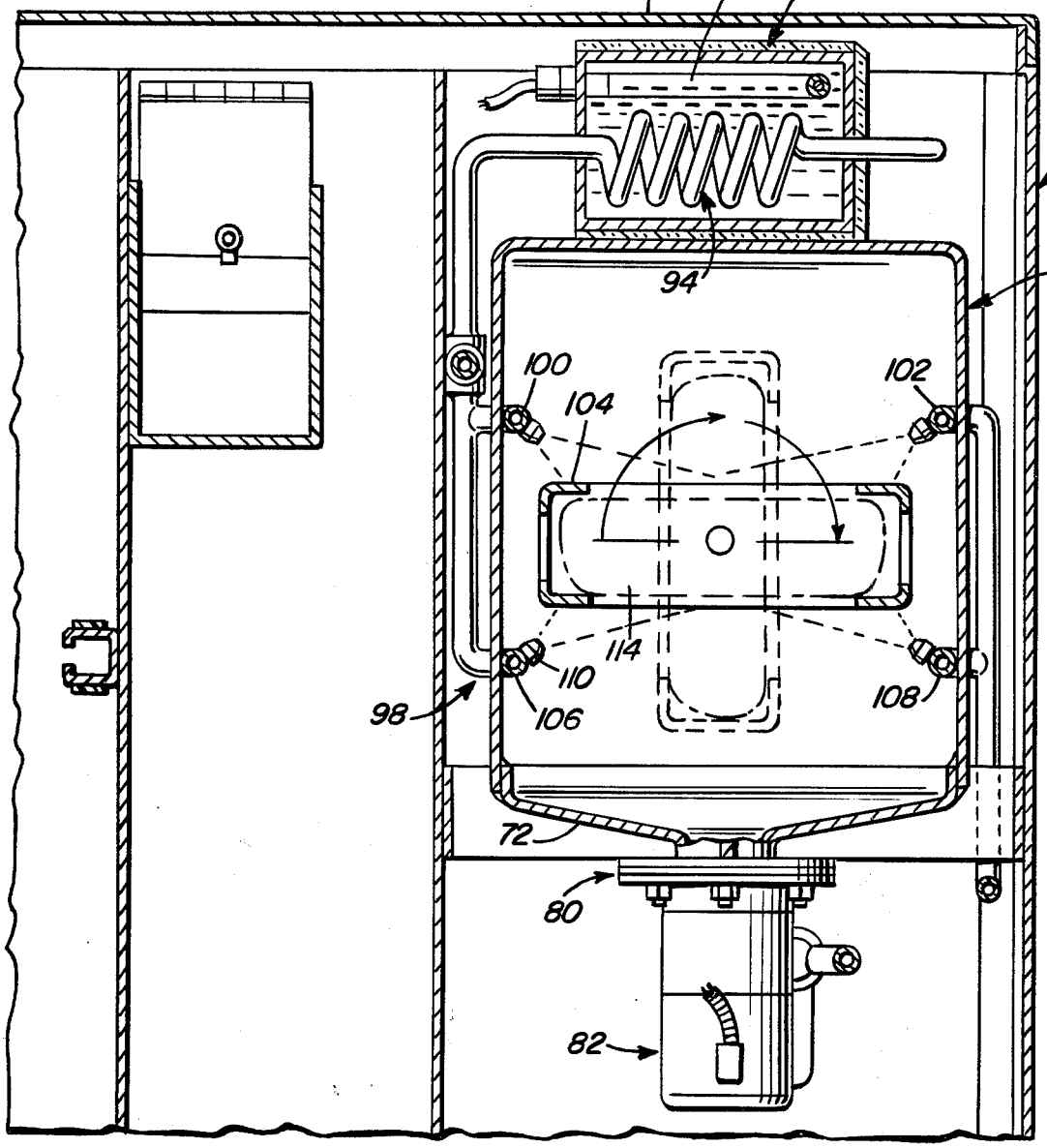
FIG. 5 is a partial rear sectional view taken substantially through a plane indicated by section line 5—5 in FIG. 4.
Figure 6:
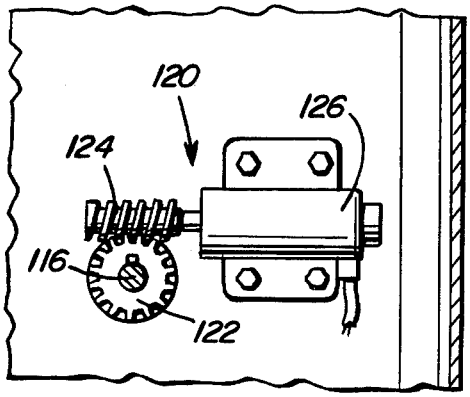
FIG. 6 is a partial sectional view taken substantially through a plane indicated by section line 6—6 in FIG. 4.

With continued reference to FIGS. 4 and 5, the outlet of the pump assembly 82 is connected to the intake of a recirculating pump assembly 92 through which liquid is recirculated into the cleaning chamber receptacle 32 during a cleaning cycle. The hot water supply conduit is connected to a heat exchange coil 94 located within the electrical heating unit 96. Accordingly, the hot water supply to the cleaning receptable 32 may be heated before it is conducted to a spray device generally referred to by reference numeral 98. The spray device in the illustrated embodiment includes an upper pair of spray tubes 100 and 102 fixedly mounted within the receptacle 32 above a pair of channel shaped holder elements 104 extending rearwardly from the front opening 20 in the horizontal position shown by solid line. A second pair of spray tubes 106 and 108 are fixedly mounted on the inside of the receptacle 32 below the channel shaped holders 104 in the horizontal position. Each of these spray tubes mounts a plurality of spaced spray nozzles 110 adapted to direct cleaning sprays of the water onto an article such as a bedpan 112 shown by dotted line in FIG. 4 adapted to be inserted between the channel holder elements 104. The channel holder elements 104 are interconnected adjacent the rear wall of the receptacle 32 by means of a bridging connector 114 to which a pivot shaft 116 is connected. The pivot shaft is journalled within a sleeve bearing 118 fixedly mounted on the rear panel 64 of the cabinet as more clearly seen in FIG. 4 in order to pivotally mount the article holder for displacement by 180 degrees between horizontal positions as shown by dotted lines and arrows in FIG. 5. A holder inverting mechanism generally referred to by reference numeral 120 is therefore connected to the pivot shaft 116. The inverting mechanism includes a worm wheel 122 in mesh with a worm gear 124. As more clearly seen in FIG. 6, the worm gear 124 is connected to the output shaft of an article inverting motor 126. Thus, the article such as the bedpan 112 loaded into the cleaning chamber receptacle 32 may be inverted during a cleaning cycle in order to expose all surfaces thereof to the cleaning action of the liquid sprays discharged from the spray nozzles 110. The spray nozzles may discharge hot and cold water during different phases of the cleaning cycle and a liquid detergent may also be injected into the cleaning chamber as will be explained hereafter. Also, as aforementioned, the cleaning liquids may be recirculated during the cleaning cycle by means of the recirculating pump 92. During the recirculating phase, the draining of liquid through the bottom 72 may be blocked while the pump assembly 82 is inoperative. The pump assembly 82 will be rendered operative to not only reduce any solids but to induce outflow of waste liquids as the end of the cleaning cycle is approached.

Figure 3:
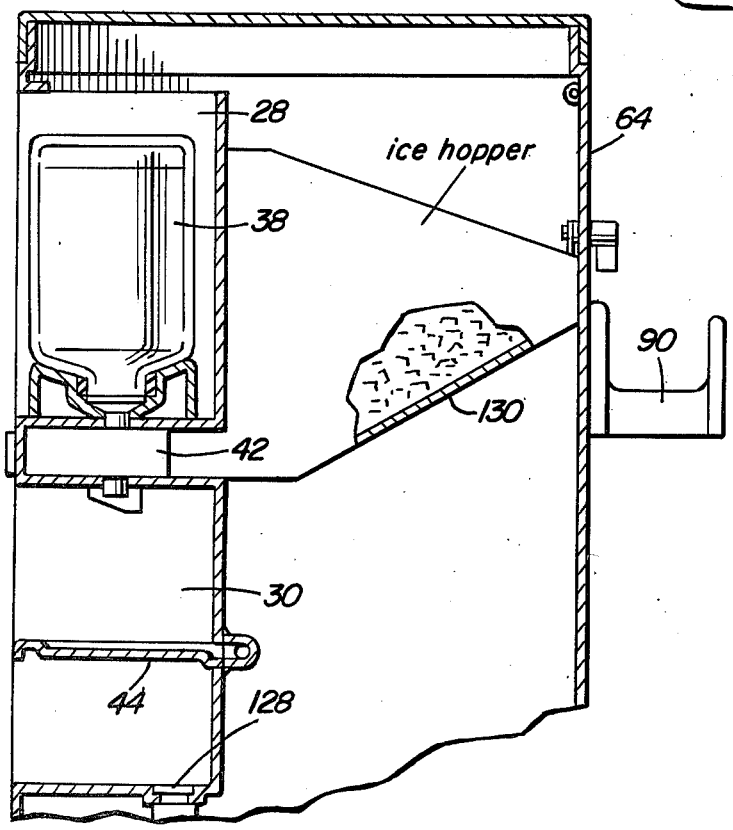
FIG. 3 is a partial side sectional view taken substantially through a plane indicated by section lines 3—3 in FIG. 1.

As shown in FIG. 3, any water collected in the cavity 30 may be drained through a drain outlet 128. Ice may be stored in the cabinet within an ice hopper 130 and dispensed under control of the gate valve 42 into a container supported on the tray 44.

Figure 7:
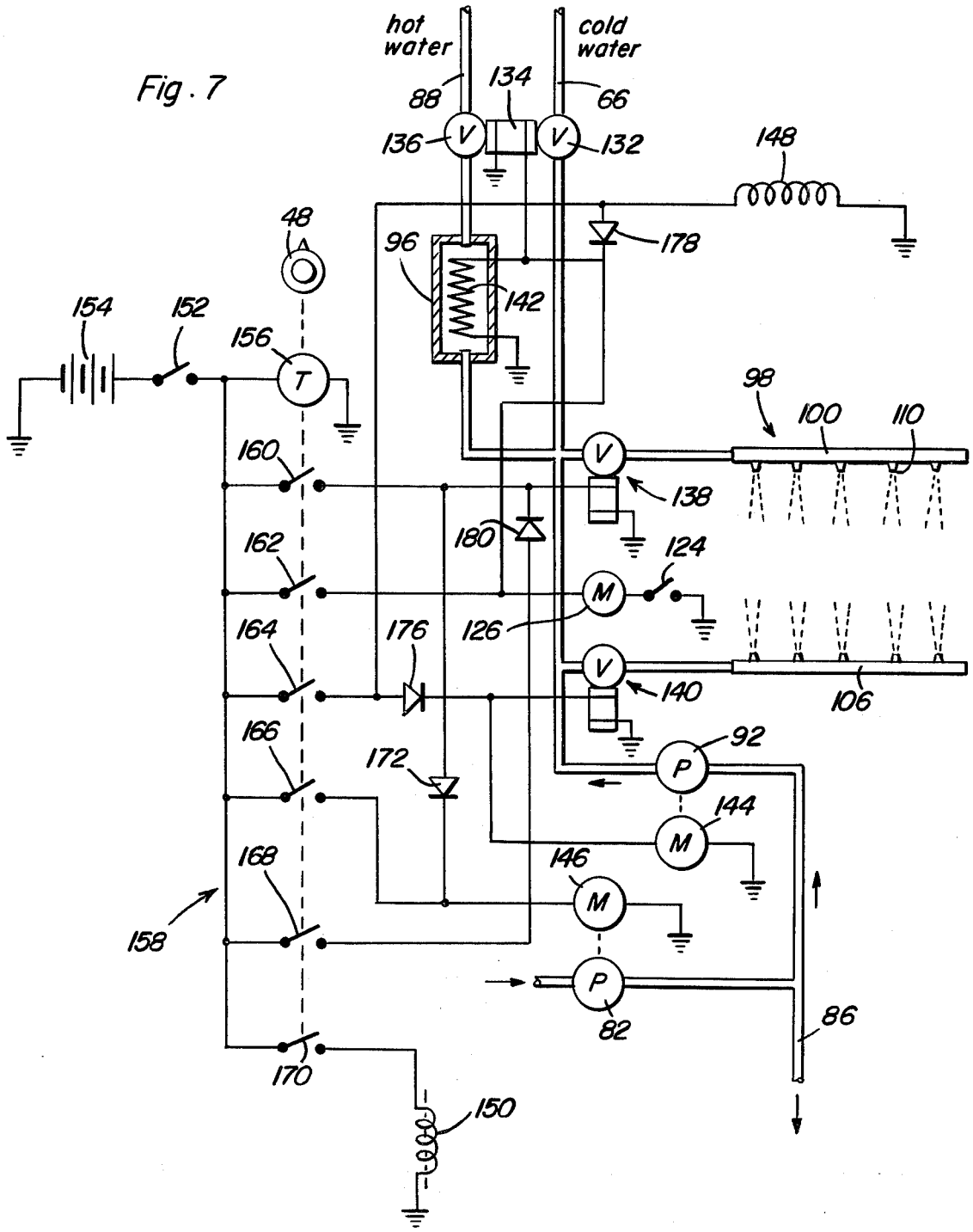
FIG. 7 is a schematic circuit diagram illustrating the control system associated with the portable nursing unit of the present invention.

Referring now to FIG. 7, the aforementioned components described in connection with the cleaning chamber receptacle 32, form part of an article cleaning system to which the cold and hot water conduits 66 and 88 are connected and to which the waste conduit 86 is also connected. Cold water is normally supplied to the spray devices 98 through normally open valve 132. Upon energization of a solenoid valve operator 134, the valve 132 is closed to block any inflow of cold water while valve 136 is opened in order to admit an inflow of hot water. Thus, cold or hot water is alternatively supplied to the upper spray tube through solenoid operated valve 138 or to the lower spray tube through solenoid operated valve 140. The hot water supplied to the spray device through the solenoid operated valve 138 and 140 is heated by means of the heater 96 including an electrical heating coil 142. The liquids collected at the bottom of the cleaning chamber receptacles are either recirculated by operation of recirculating pump 92 upon energization of the pump motor 144 or the waste liquids are drained from the cleaning receptacle by operation of the pump 82 upon energization of the pump motor 146. During the cleaning cycle, liquid detergent may be injected into the cleaning chamber receptacle by energization of a detergent dispenser solenoid 148. Also associated with the cleaning system is a latch release solenoid 150 adapted to be energized at the end of a cleaning cycle in order to release the latch 78 holding the door 24 locked. The cleaning cycle is initiated when the door 24 is closed as detected by a sensor switch 152 through which the source of electrical energy 154 is connected to the timer 156 associated with the time selector knob 48.

The timer when set into operation upon closing of the sensor switch 152 controls operation of a programming control circuit generally referred to by reference numeral 158 which includes a plurality of sequence control switches 160, 162, 164, 166, 168 and 170. Assuming that a bedpan is loaded into the cleaning chamber receptacle, and the door 24 is closed to seal the cleaning chamber, the sensor switch 152 will be closed in order to initiate a timing cycle through the timer 156. During a first rinse phase of the cleaning cycle, the sequence switch 160 is closed for a period of 10 seconds during which the solenoid control valve 138 is energized to open and admit cold water through valve 132 to the upper spray tubes of the spray device 98. At the same time, energizing current is conducted through diode 172 to the pump motor 146 in order to drain liquid from the cleaning chamber receptacle. The initial rinse phase is then followed by closure of the sequence switch 162 to energize the motor 126 associated with the inverting mechanism. The article or bedpan is accordingly inverted through an arc of 180° to thereby dump water and wastes therein. When the bedpan has been inverted by 180°, a limit switch 174 is opened in order to de-energize the motor 126. Following such reorientation of the article to be cleaned, the sequence switch 164 is closed for a period of 5 minutes during which energizing current is conducted by diode 176 to the solenoid valve 140 in order to open it and thereby admit an inflow of water to the lower spray tube for washing the inverted bedpan. Current is supplied at the same time to the detergent dispensing solenoid 148 for energization thereof effecting the injection of a predetermined quantity of detergent into the cleaning chamber receptacle. Energizing current is also conducted by diode 178 to the heating element 142 associated with the electrical heater 96 and to the solenoid valve operator 134. Accordingly, the cold water valve 132 is closed and the hot water valve 136 is opened in order to effect the supply of hot water heated by the heater 96 to the opened solenoid valve 140. During this phase of the cleaning cycle, current is also supplied to the motor 144 for energization thereof in order to operate the recirculating pump 92. Upon completion of the washing phase of the cleaning cycle, the sequence switch 166 is closed for a period of 30 seconds during which current is supplied to the pump motor 146 in order to effect drainage of liquid and solids from the cleaning receptacle by operation of the pump 82. During the next operational phase, the sequence switch 168 is closed for a period of 2 minutes during which the solenoid valve 138 is energized through diode 180 in order to effect a rinse operation once again. At the end of the cleaning cycle, the sequence switch 162 is opened to permit the inverting mechanism to be restored to the initial position and switch 170 is closed in order to energize the lock release solenoid 150 in order to permit opening of the door 24 for removal of the clean bedpan.

It will be apparent from the foregoing description that the present invention provides a portable or mobile unit for use in hospitals, nursing homes and private homes to facilitate care for bed patients in connection with their personal bathing, bowel and urinal needs. Thus, the nursing unit of the present invention provides for the cleaning of a bedpan by initiating a cleaning cycle upon depression of the push button control 46, the duration of the cleaning cycle being selected through the control knob 48. During the cleaning cycle the contents of the bedpan loaded into the receptacle chamber 32 will be disposed of including disposal of bowel and urine elemination and the bedpan thoroughly cleaned for reuse. A pull-out sink basin 34 is also provided with all of the water and waste connections so that the bed patient may wash and bathe. Other convenience facilities such as the drinking water and ice dispenser are provided. It should, of course, be appreciated that other accessories and service facilities may be included in the cabinet.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In a portable nursing unit having a plurality of liquid receiving receptacles and a plurality of flexible conduits connected thereto through which liquid is conducted to and from said receptacles, a mobile cabinet enclosing the conduits and said receptacles, closure means mounted on the cabinet for alternately concealing and exposing two of said receptacles enclosed in the cabinet when displaced between closed and open positions, control valve means connected to two of said conduits for selectively supplying liquid to said receptacles, means connecting a third of the conduits to each of the receptacles for draining waste liquid therefrom, means responsive to movement of one of the closure means to the closed position for sealing one of the receptacles internally of the cabinet, and means rendered operative in response to movement of the other of the closure means to open position for supporting the other of the receptacles externally of the cabinet, said other of the receptacles being displaceable between an extended position supported on the other of the closure means and a retracted position stored internally of the cabinet.

2. The combination of claim 1 including means rendered operative in response to said sealing of said one of the receptacles for cleaning articles loaded therein.

* * * * *